US005246219A

United States Patent [19]

Watkiss

[11] Patent Number: 5,246,219

[45] Date of Patent: Sep. 21, 1993

[54] SHEET FEEDING METHODS AND APPARATUS WITH SHEET MODULES AND POWER PACK STACKED ACCORDINGLY

[75] Inventor: Christopher R. Watkiss, Biggleswade, England

[73] Assignee: Watkiss Automation Limited, Bedfordshire, England

[21] Appl. No.: 689,772

[22] PCT Filed: Sep. 19, 1990

[86] PCT No.: PCT/GB90/01444

§ 371 Date: May 17, 1991

§ 102(e) Date: May 17, 1991

[87] PCT Pub. No.: WO91/04215

PCT Pub. Date: Apr. 4, 1991

[30] Foreign Application Priority Data

Sep. 19, 1989 [GB] United Kingdom ..... 8921142

[51] Int. Cl.[5] ..... B65H 39/02; B65H 3/44

[52] U.S. Cl. ..... 270/58; 270/54; 271/9

[58] Field of Search ..... 270/52, 54, 56, 58; 271/9

[56] References Cited

U.S. PATENT DOCUMENTS

| | | | |
|---|---|---|---|
| 4,849,790 | 7/1989 | Ho | 271/9 X |
| 5,039,077 | 8/1991 | Gunther, Jr. | 270/52 |

FOREIGN PATENT DOCUMENTS

| | | | |
|---|---|---|---|
| 0267608 | 5/1988 | European Pat. Off. . | |
| 2304106 | 8/1974 | Fed. Rep. of Germany . | |
| 1924187 | 11/1977 | Fed. Rep. of Germany | 270/58 |
| 2842481 | 4/1980 | Fed. Rep. of Germany | 270/58 |
| 2324552 | 4/1977 | France | 270/58 |
| 36829 | 3/1979 | Japan | 270/58 |
| 23551 | 2/1982 | Japan | 270/52 |
| 160858 | 10/1982 | Japan | 270/52 |
| 123764 | 5/1988 | Japan | 270/58 |
| 63-106268(A) | 11/1988 | Japan . | |
| 1-92172(A) | 4/1989 | Japan . | |
| 1-167129(A) | 6/1989 | Japan . | |
| 220677 | 9/1989 | Japan | 270/52 |

*Primary Examiner*—Edward K. Look
*Assistant Examiner*—John Ryznic
*Attorney, Agent, or Firm*—Seidel, Gonda, Lavorgna & Monaco

[57] ABSTRACT

In a sheet feeding apparatus, e.g. a collator, comprising a variable plurality of modules (12*a*, 12*b*, 12*c*, 14') stacked one above another, and each incorporating a sheet storage station (14), means are provided for directing sheets (15) from said stations in a requested sequence laterally and downwardly into a common transmission path to below the lowest module (12*a*). A power pack (18) for the whole stack is mounted above the uppermost module.

28 Claims, 3 Drawing Sheets

SHEET FEEDING METHODS AND APPARATUS WITH SHEET MODULES AND POWER PACK STACKED ACCORDINGLY

This invention relates to methods of and apparatus for feeding sheets of material, especially sheets of paper. Various paper sheet feeders and collating machines are known which deliver sheets of paper from individual bins or compartments in such a manner as to create a desired end product which consists of a plurality of such sheets.

One of the disadvantages of known collators and like machines is that the number of bins in the machine is fixed, which means that the customer has to make a decision between buying a machine which will just meet his present needs or paying more for a larger machine in the hope that he will be able to make future use of the additional bin capacity.

It is an object of the present invention to create a sheet feeding machine which is completely modular. The sheet feeding machine is preferably a collator. The advantage of a fully modular construction is that the user can start with a small number of modules and build up the machine as necessary by adding further modules.

It is a further object of the invention to provide a sheet feeding machine which is arranged as a tower of modules, with the sheets being constrained to travel down towards the base of the tower.

It is yet another object of the invention to provide a sheet feeding machine which is constructed so as to facilitate use of the machine by the operator, i.e. to have the sheets in positions which are readily accessible, and to have the control mechanisms in positions which do not create obstructions but which nevertheless enable the operator readily to monitor the controls.

In accordance with the present invention there is provided a sheet feeding apparatus which comprises a variable plurality of modules stacked one above another, each of which incorporates a sheet storage station, and means for directing sheets from said plurality of storage stations in a requested sequence laterally and downwardly into a common transmission path to below the lowest module.

Preferably, an electrical power pack for the apparatus is provided at the top of the stack of modules, as a tower system. The front of the power pack may contain means for providing a visual display of relevant information. The individual modules are linked together down the stack by suitable mechanisms and the apparatus incorporates appropriate electronic circuitry for control and monitoring purposes.

Each module, i.e. sheet storage station, is complete within itself and, when attached to the power pack, is capable of functioning alone.

Also in accordance with the invention there is provided a method of feeding sheets from a variable plurality of modules stacked one above another and each incorporating a sheet storage station, which comprises directing sheets from said plurality of sheet storage stations in a requested sequence laterally and downwardly into a common transmission path to below the lowest module.

The number of modules in any one stack will depend upon customer requirements and the needs and constraints of any particular installation. The apparatus can thus be assembled in a customised manner to meet specific requirements.

In order that the invention may be more fully understood, one presently preferred embodiment of collating system in accordance with the invention will now be described by way of example and with reference to the accompanying drawings.

Figure 1:
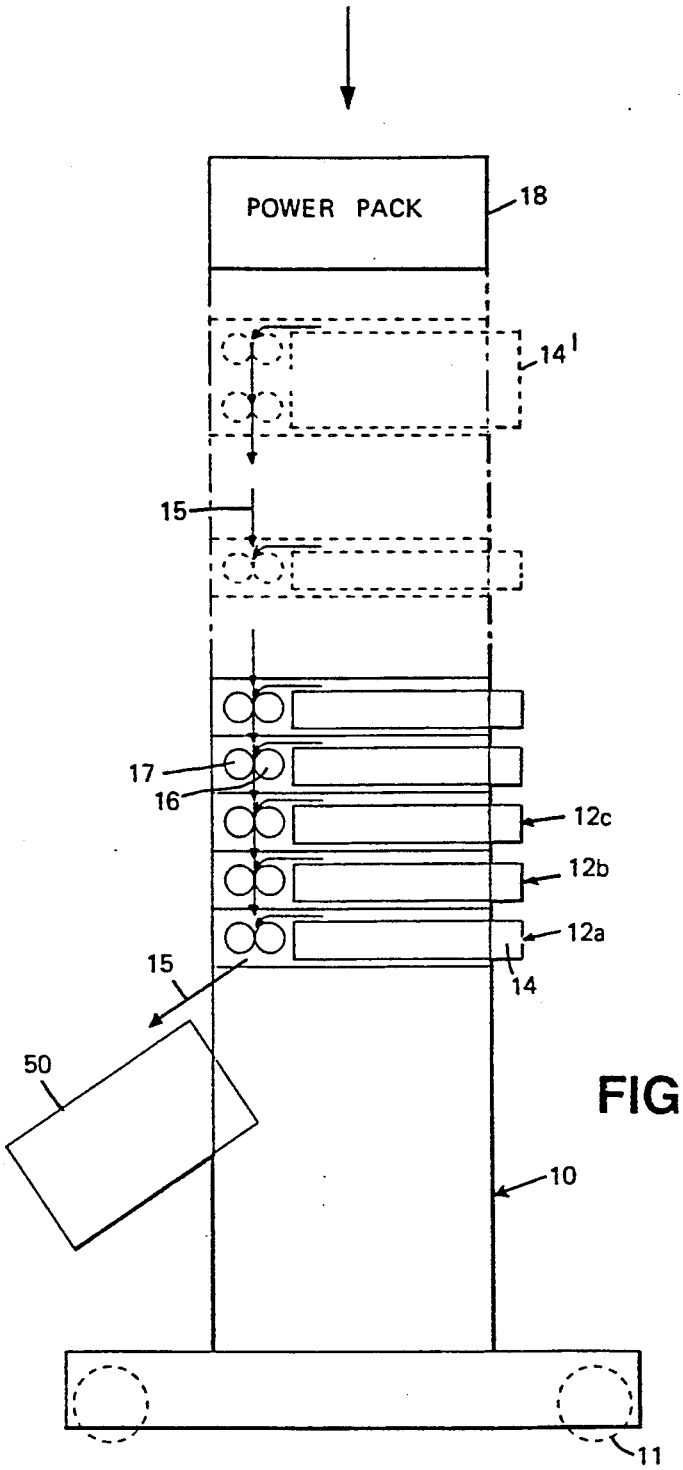
FIG. 1 is a schematic diagram of a sheet feeding apparatus in accordance with the invention constructed as a tower.

As shown in the drawings, the collating system comprises a base/floor stand 10, which is preferably provided with wheels or rollers 11 so that the collator can be made mobile. The stand carries a stack of individual modules, indicated at 12*a*, 12*b*, 12*c*, etc. These modules each include a sheet storage and feed bin 14. Each module constitutes a feed station for the sheets of paper held within the module. The feed bins in the individual modules may be of different depths. As shown in the drawing, a "double depth" bin is indicated by broken lines at 14' towards the top of the stack. The stack may comprise any number of individual modules, although normally this will be between two and twenty.

Each module or feed station is complete within itself, containing all the mechanisms necessary for operation, e.g. sheet feeding mechanism, tray height sensing means, sheet monitoring means, conveying mechanism, etc. The delivery of the sheets from the feed bins can be effected by a friction feed mechanism or by a suction feed mechanism or in any other appropriate way. One can have friction feed bins and suction feed bins within the same stack. Full details of this will be described hereinafter. The direction of movement of the sheets is indicated in FIG. 1 by the illustrated sheets 15. For each bin the sheets are moved first laterally and then directly downwards into a common transmission path which extends between pairs of opposed rollers 16, 17 at the forward side of each module. In a preferred embodiment of the apparatus, those feed bins from which a sheet is to be dispensed are tilted when a coded instruction to that bin is given by the machine control system, and the tilting of the bin then triggers the delivery process for the top sheet in that bin. Because the modules are shallow and closely stacked together, the sheets travel downwards singly or in overlapping sets from one set of rollers to the next without the need for any transfer belts.

At the top of the collating system stack is a power pack 18 which contains all the mechanical and electrical drive systems for the modules in a single interchangeable unit. For example, the power pack can include the conveyor drive, an air blower motor, a tray lowering motor, control electronics, etc. The front of the power pack preferably carries switch controls, push-buttons and visual display means so that the operator can check the functioning of the system. The individual modules 12*a*, 12*b*, 12*c* . . . can be stacked in any sequence, the junction points simply docking together to form a fully integrated collation system of two or more stations. The individual modules are linked together down the side of the stack by suitable coupling and drive mechanisms and the machine incorporates appropriate electronic circuitry for control and monitoring purposes.

Figure 2:
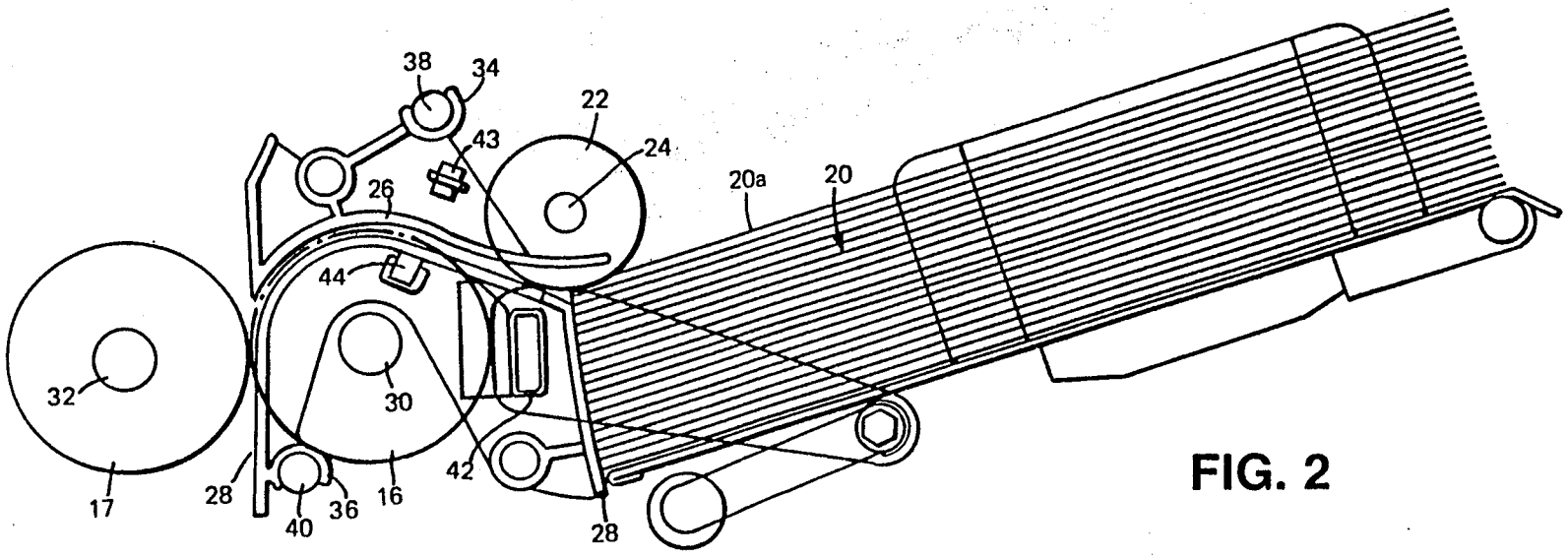
FIG. 2 is a diagram, on an enlarged scale, of one of the modules showing the sheet feed mechanism in greater detail.

FIG. 2 shows more details of the sheet feed mechanism within each module. A stack of sheets 20 of paper, card or like material is placed within a bin or compartment which is adapted to be loaded from what is shown as the right-hand side in FIG. 2. Above the sheets 20 and adjacent to the output end of the bin is a friction feed roller 22. In practice, a plurality of such rollers are provided spaced along the length of a shaft 24 which extends across the width of the apparatus. As mentioned above, when a sheet is to be dispensed from the bin, the bin is tilted into the position illustrated in FIG. 2 where the top sheet comes into contact with the rotating friction feed roller 22 causing the top sheet to be taken from the bin and transferred laterally into a path between an upper guide 26 and a lower guide 28. In traversing this path the sheet is guided into contact with a roller 16 which is mounted on a shaft 30. Associated with this roller 16 is a contact roller 17 which is mounted on a shaft 32. The two rollers 16 and 17 define a nip between which the sheets pass in a downward direction. As shown in FIG. 2, the guided path for the sheets around the roller 16 extends over about 90° of the circumference of the roller. The guides 26 and 28 are preferably prefabricated components which can be clipped into place by having arcuate clip portions 34 and 36 respectively which snap into place over rods 38 and 40 respectively which extend across the width of the apparatus.

In order to assist in the separation of the top sheet 20*a* of the stack 20 from the remaining sheets, a flow of air is directed towards the leading edge of the sheets in order to assist in the separation. This blown air is created by providing a hollow bar or tube 42 which extends across the width of the bin and which is supplied with air under pressure. The bar or tube 42 is provided with holes, slots or the like in the zone facing the leading edge of the sheets. Also provided within each module is a sheet misfeed detector comprising sensors 43 and 44 on respective opposite sides of the sheet path around the roller 16.

Instead of using a friction feed roller 22 above the stack of sheets in a bin one can alternatively use a suction mechanism, for example a bellows mechanism of the type described in U.S. Pat. No. 4,717,138.

In operation, the machine can be loaded with a plurality of different sheets in the individual bins and the operator, just by pushing control buttons on the front of the machine, can select which sheets are to be collated together in the final pamphlet or brochure or whatever. The machine will then select the sheets from the relevant bins automatically in the requested sequence and dispense them in the appropriate order.

Figure 3:
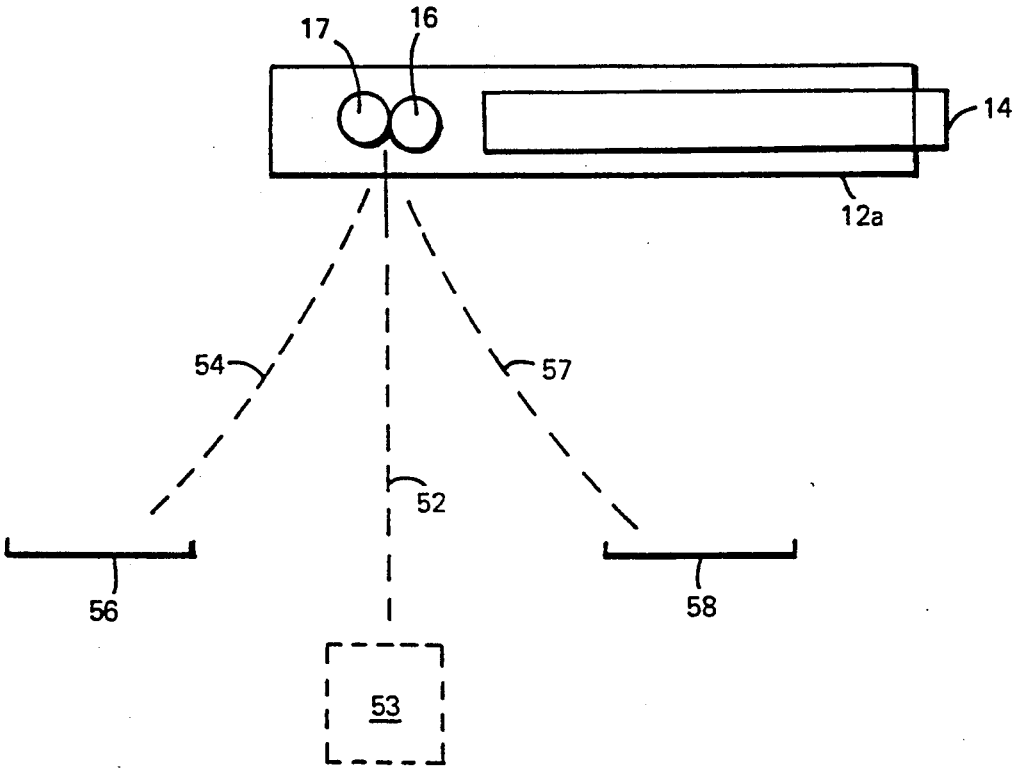
FIG. 3 shows alternative paths for the collated sheets at the bottom of the tower.

As is shown in FIG. 1, the collated sheets can be directed from the bottom of the stack, i.e. below the level of the lowest module 12*a*, into a collecting bin 50. FIG. 3 shows other alternative ways of utilising the collated sheets. As indicated by the central broken line 52, the sheets can pass straight down from the transmission path through the rollers and be directed to another machine or apparatus positioned below the collator, for example a stitcher-folder machine 53. Alternatively, as indicated by the broken line 54, the collated sheets can be directed forwardly of the stack of modules and deposited on a cross conveyor 56. As yet a further alternative, the collated sheets can be directed as indicated by the broken line 57 rearwardly to a cross conveyor 58. If this path is followed then the sheets will be deposited on the conveyor 58 in an inverted manner, which may be preferred for certain purposes.

Although the present invention is based upon the concept of stacking a plurality of modules one above another to form a tower, one could also provide a collating system which comprises a plurality of such towers arranged side by side to create a pattern of feed bins.

In the event that there is a problem with or failure of any one of the individual feed bins or of a power pack, it is simply necessary to remove the relevant module or the power pack from the system and replace it with a new module or power pack.

Also, if additional modules are required, it is a simple matter to add further modules to the stack without the need for any dismantling or rearrangement of the existing structure.

I claim:

1. Sheet feeding apparatus comprising:
   - a variable plurality of modules incorporating a plurality of sheet storage stations and stacked one above another in the form of an augmentable tower;
   - means for directing sheets from said plurality of storage stations in a requested sequence laterally and downwardly into a common transmission path; and
   - a modular electrical power pack positioned at the top of the stack of modules.

2. An apparatus according to claim 1, in which the sheets are fed downwards in the transmission path between opposed pairs of rollers without intermediate belts.

3. An apparatus according to claim 1, in which each sheet storage station includes a storage bin which is tilted to trigger the removal of the top sheet from that bin.

4. An apparatus according to claim 1, in which a rotatable friction feed roller is provided above each sheet storage station for contact with the top sheet in the station.

5. An apparatus according to claim 1, in which a suction feed mechanism is provided above each sheet storage station for contact with the top sheet in the station.

6. An apparatus according to claim 1, which includes means to supply a flow of air toward the leading edge of the uppermost sheet in each storage station thereby to assist in the separation of said uppermost sheet from the sheet stack.

7. An apparatus according to claim 1, in which the sheets at the bottom of the transmission path continue to travel substantially vertically downwards to another apparatus.

8. An apparatus according to claim 1, in which the sheets at a position below the lowest module can be directed either forwardly or rearwardly from the vertical downward path to conveyor means.

9. Sheet feeding apparatus comprising:
   - a variable plurality of modules incorporating a plurality of sheet storage stations and stacked one above another in the form of an augmentable tower;
   - means for directing sheets from said plurality of storage stations in a requested sequence laterally and downwardly into a common transmission path; and
   - a module electrical power pack positioned as an element in said augmentable tower to control the dispensing of sheets from the storage stations.

10. An apparatus according to claim 9, in which the sheets are fed downwards in the transmission path between opposed pairs of rollers without intermediate belts.

11. An apparatus according to claim 9, in which each sheet storage station includes a storage bin which is tilted to trigger the removal of the top sheet from that bin.

12. An apparatus according to claim 9, in which a rotatable friction feed roller is provided above each sheet storage station for contact with the top sheet in the station.

13. An apparatus according to claim 9, in which a suction feed mechanism is provided above each sheet storage station for contact with the top sheet in the station.

14. An apparatus according to claim 9, which includes means to supply a flow of air toward the leading edge of the uppermost sheet in each storage station thereby to assist in the separation of said uppermost sheet from the sheet stack.

15. An apparatus according to claim 9, in which the sheets at the bottom of the transmission path continue to travel substantially vertically downwards to another apparatus.

16. An apparatus according to claim 9, in which the sheets at a position below the lowest module can be directed either forwardly or rearwardly from the vertical downward path to conveyor means.

17. Sheet feeding apparatus comprising a variable plurality of modules stacked one above another in the form of an augmentable tower, each module incorporating a sheet storage station, means for directing sheets from said plurality of storage stations in a requested sequence laterally and downwardly into a common transmission path to below the lowest module, and a modular electrical power pack positioned at the top of the stack of sheet-storage modules.

18. Sheet feeding apparatus comprising a variable plurality of modules stacked one above another in the form of an augmentable tower, each module incorporating a sheet storage station, means for directing sheets from said plurality of storage stations in a requested sequence laterally and downwardly into a common transmission path to below the lowest module, a modular electrical power pack positioned at the top of the stack of sheet storage modules, and said power pack has a front panel providing a visual display of control information.

19. An apparatus according to claim 17, in which the sheets are fed downwards in the transmission path between opposed pairs of rollers without intermediate belts.

20. An apparatus according to claim 17, in which each sheet storage station includes a storage bin which is tilted to trigger the removal of the top sheet from that bin.

21. An apparatus according to claim 17, in which a rotatable friction feed roller is provided above each sheet storage station for contact with the top sheet in the station.

22. An apparatus according to claim 17, in which a suction feed mechanism is provided above each sheet storage station for contact with the top sheet in the station.

23. An apparatus according to claim 17, which includes means to supply a flow of air towards the leading edge of the uppermost sheet in each storage station thereby to assist in the separation of said uppermost sheet from the sheet stack.

24. An apparatus according to claim 17, in which the sheets at the bottom of the transmission path continue to travel substantially vertically downwards to another apparatus.

25. An apparatus according to claim 17, in which the sheets at a position below the lowest module can be directed either forwardly or rearwardly from the vertical downward path to conveyor means.

26. A method of feeding sheets from a variable plurality of modules incorporating a plurality of sheet storage stations, said modules stacked one above another in the form of an augmentable tower, said method comprising directing sheets from said plurality of sheet storage stations in a requested sequence laterally and downwardly into a common transmission path to below the lowest module, and controlling said sequence of dispensation of the sheets from a modular power pack positioned at the top of the stack of modules.

27. A method of feeding sheets from a variable plurality of modules stacked one above another in the form of an augmentable tower and each incorporating a sheet storage station, which comprises directing sheets from said plurality of sheet storage stations in a requested sequence laterally and downwardly into a common transmission path to below the lowest module, said method further including controlling said sequence of dispensation of the sheets from a modular power pack positioned as an element of said augmentable tower of said stacked modules.

28. A method of feeding sheets from a variable plurality of modules stacked one above another in the form of an augmentable tower and each incorporating a sheet storage station, which comprises directing sheets from said plurality of sheet storage stations in a requested sequence laterally and downwardly into a common transmission path to below the lowest module, said method further including controlling said sequence of dispensation of the sheets from a modular power pack positioned at the top of the stack of modules.

* * * * *